United States Patent [19]

Feinman et al.

[11] 4,321,242

[45] Mar. 23, 1982

[54] LOW SULFUR CONTENT HOT REDUCING GAS PRODUCTION USING CALCIUM OXIDE DESULFURIZATION WITH WATER RECYCLE

[75] Inventors: Jerome Feinman, Grand Junction, Colo.; Joseph E. McGreal, Jr., Penn Hills Township, Allegheny County, Pa.

[73] Assignee: United States Steel Corporation, Pittsburgh, Pa.

[21] Appl. No.: 192,404

[22] Filed: Sep. 30, 1980

[51] Int. Cl.[3] ..... C01B 17/00; B01J 8/00; C01F 1/00; C01B 17/16

[52] U.S. Cl. ..... 423/244; 423/164; 423/563; 423/638; 423/230

[58] Field of Search ..... 423/242 A, 242 R, 244 A, 423/244 R, 230, 563, 164, 638, 571, 572, 225, 234

[56] References Cited

U.S. PATENT DOCUMENTS

| | | | |
|---|---|---|---|
| 1,235,953 | 8/1917 | Bacon | 423/564 |
| 2,551,905 | 5/1951 | Robinson | 23/2 |
| 2,898,194 | 8/1959 | Eells et al. | 23/201 |
| 3,402,998 | 9/1968 | Squires | 23/181 |
| 3,625,164 | 12/1971 | Spector | 423/244 |
| 3,870,480 | 3/1975 | Moss | 423/244 |
| 3,917,795 | 11/1975 | Pelczarski et al. | 423/168 |
| 3,969,089 | 7/1976 | Moss et al. | 423/244 |
| 4,002,720 | 1/1977 | Wheelock et al. | 423/230 |
| 4,011,299 | 3/1977 | Henis et al. | 423/239 |
| 4,118,201 | 10/1978 | Yan | 44/1 R |
| 4,164,544 | 8/1979 | Olsson et al. | 423/230 |

FOREIGN PATENT DOCUMENTS

| | | | |
|---|---|---|---|
| 658452 | 2/1963 | Canada | 423/230 |
| 2334 | of 1884 | United Kingdom | 423/563 |
| 1183937 | 3/1970 | United Kingdom | 423/244 |
| 1384711 | 10/1976 | United Kingdom . | |
| 1451741 | 10/1976 | United Kingdom . | |

OTHER PUBLICATIONS

Turkdogan, U.S. Serial No. 154,731, filed 5-29-80.
Feinman et al., U.S. Serial No. 158,190, filed 6-11-80.
Tippmer, Production of Reducing Gases from Hydrocarbons and Coals Based on the Single Heat Principle, Metallurgical Plant & Tech. 4/1978.
Clean Air: Simply, Combustion Power Company.

*Primary Examiner*—O. R. Vertiz
*Assistant Examiner*—Gregory A. Heller
*Attorney, Agent, or Firm*—W. Gary Goodson

[57] ABSTRACT

A process and apparatus for producing a low sulfur content, hot reducing gas by desulfurizing hot reducing gas by contacting the sulfur-bearing hot reducing gas with a bed of a particulate calcium oxide desulfurizing agent to thereby produce a product gas stream and a byproduct calcium sulfide composition, and then recovering sulfur from the calcium sulfide composition by contacting the calcium sulfide composition with hot liquid water at a temperature and corresponding pressure sufficient to maintain steam in the system and to thereby convert the sulfide to calcium hydroxide and hydrogen sulfide and to produce a liquid water stream containing sulfur, and then combining the sulfur-containing water stream with a fresh water stream and recycling this water stream for contacting the calcium sulfide composition. Preferably water vapor produced in the contacting step is condensed and returned to the system in the final stage of contacting the calcium sulfide composition with hot liquid water.

28 Claims, 4 Drawing Figures

FIG. 1
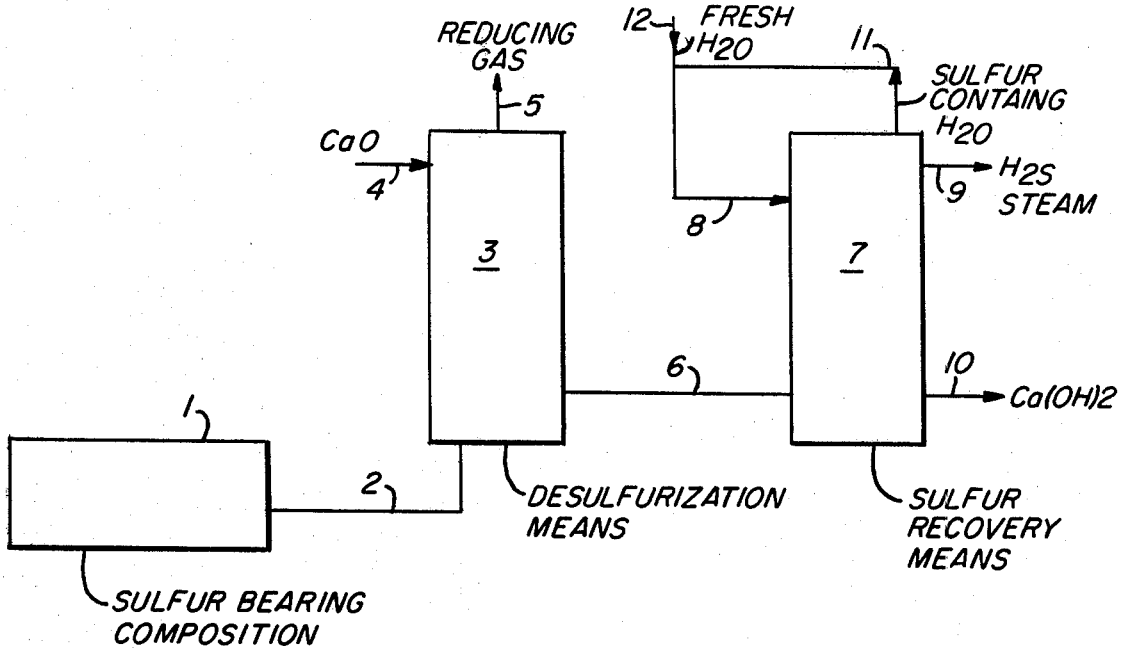
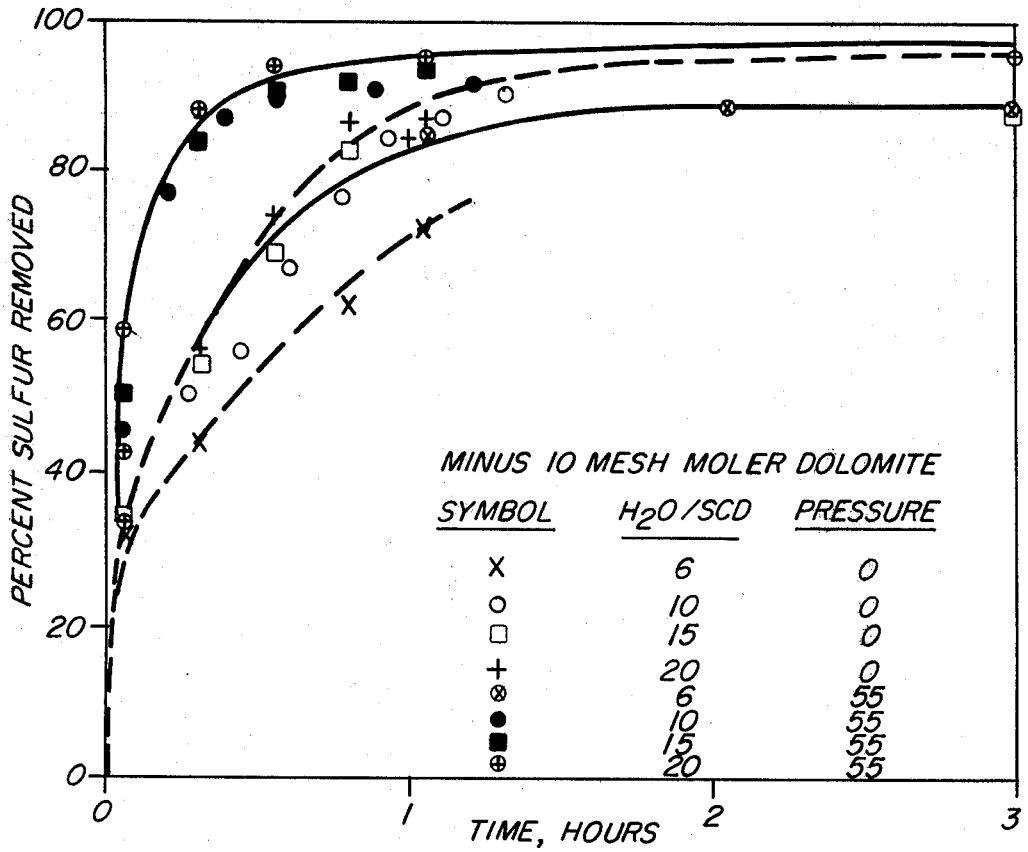
FIG. 2

LOW SULFUR CONTENT HOT REDUCING GAS PRODUCTION USING CALCIUM OXIDE DESULFURIZATION WITH WATER RECYCLE

BACKGROUND OF THE INVENTION

This invention relates to a process and apparatus for producing low sulfur content hot reducing gas and especially that gas formed by the combustion and gasification of sulfur-bearing carbonaceous fuel. The gasification of solid carbonaceous fuel, such as by reaction with a limited quantity of oxygen to produce carbon monoxide, is well known. Either pure oxygen or air, with or without steam, may be utilized in the reaction. The products of combustion are reducing gases including carbon monoxide, hydrogen, carbon dioxide, water vapor and nitrogen. Hydrogen is produced from the hydrocarbons in the fuel, and also by reaction of injected steam with carbon, while nitrogen may be brought in by air and may also be contained in the fuel. Carbon dioxide and water vapor may also be used to react with the carbonaceous fuel and the reducing gas produced therefrom to vary the final composition of the product reducing gas.

One of the serious problems with gasification of carbonaceous fuels is that many commercially available carbonaceous fuels contain sulfur. Sulfur-containing reducing gases, usually predominantly hydrogen sulfide, are produced when these fuels are reacted with air or oxygen in a gasification process. These sulfur-containing gases in the reducing gas are objectionable for a number of reasons. One reason is that when the sulfur finally ends up in the atmosphere, it results in serious pollution problems. Additionally, this sulfur should be removed from the product gas before its use in many applications, such as metallurgical reducing gas where it will contaminate the metal produced, synthesis gas where it will poison the catalyst in the reaction system, or feed stock for pipeline gas where it may promote corrosion and other detrimental effects. Also, if the product gas is burned to raise steam or generate electricity, it is advantageous to remove the $H_2S$ before combustion rather than having to remove $SO_2$ from the larger volume of combusted gas. In at least two of these applications, i.e. as a reducing gas for direct reduction of iron ore or fuel for gas-turbine engines, it is desirable to remove the $H_2S$ while the product gas is still hot so that gas can be used directly without loss of heat values.

To offset the cost of desulfurizing the hot reducing gases, the byproducts of sulfur removal should be marketable: (i) recovery of sulfur from the spent absorbent, (ii) regeneration of absorbent for recycle, or (iii) marketing the treated spent absorbent, after the recovery of sulfur, for other applications. The absorbent used for desulfurization of hot reducing gases should have the capability of lowering the sulfur content of the treated gas to below 100 ppm without much changing the reducing capacity or fuel value of the gas.

Attempts have been made to remove the sulfur during the gasification reaction itself. U.S. Pat. No. 3,533,730, incorporated herein by reference, is an example of such a process whereby the carbonaceous fuel is reacted with a controlled quantity of oxygen beneath the surface of a molten iron bath and whereby lime on the surface of the molten iron bath is used to desorb sulfur from the iron bath. Sulfur is then recovered from the coal ash-lime-sulfur molten slag byproduct. There are serious questions concerning the practical operability of this process. The rate of coal gasification depends upon the rate of coal dissolution for a given melt size, which are relatively slow compared with volumetric gasification rates for other processes. Furthermore, the sulfur in the slag byproduct is recovered only by costly additional steps. The gasification product generally contains fly ash which also requires an extra step for removal.

The use of calcined dolomite has been suggested for a regenerative cycle process of desulfurization of hot reducing gases. See U.S. Pat. Nos. 3,276,203; 3,296,775; 3,307,350; 3,402,998; and 3,853,538, each incorporated herein by reference. While dolomite is an effective gas-desulfurizing agent, the most commonly proposed method of regenerating dolomite, reacting with $CO_2$ and $H_2O$ under slightly reducing conditions at pressures greater than about 50 psig and temperatures preferably about 1000°-1200° F. to liberate $H_2S$, does not achieve complete regeneration of the dolomite. One of the problems is that calcium carbonate formed in the regeneration coats the regenerated dolomite thereby reducing its effectiveness. Furthermore, because the spent dolomite contains appreciable nonregenerated calcium sulfide, it must undergo expensive and complete treatment to bring it to a state suitable for disposal without causing pollution of the air and groundwater. When dolomite is calcined after having been regenerated by the above suggested process, some of the residual sulfur in the dolomite can be released, which requires difficult treatment to bring the stack gas to a condition suitable for venting to the atmosphere.

Copending and commonly assigned application Ser. No. 154,731, filed May 29, 1980, by E. T. Turkdogan and entitled "Low Sulfur Content Hot Reducing Gas Production Using Calcium Oxide Desulfurization", incorporated herein by reference, teaches a process for removing sulfur from a hot reducing gas stream by contacting the gas stream with a fixed bed of particulate calcium oxide desulfurizing agent, such as calcined dolomite. The desulfurizing agent is used one time and is then contacted with boiling water or wet steam, preferably under pressure, to remove the sulfur from the calcium sulfide composition produced in the gas desulfurizing step. A basic problem with this process is that when the reducing gas stream initially contains significant fly ash then the fixed bed rapidly becomes plugged with fly ash, thus resulting in plant shut downs and wasted desulfurizing agent. The invention described in copending and commonly assigned application Ser. No. 158,190, filed June 11, 1980, by J. Feinman and J. E. McGreal, Jr. and entitled, "Low Sulfur Content, Fly Ash Free Hot Reducing Gas Production Using Calcium Oxide Desulfurization", incorporated herein by reference, teaches a solution to the fly ash problem by using a moving bed of desulfurizing agent so that the fly ash is continually removed with the spent desulfurizing agent. After removal of the sulfur from the spent desulfurizing agent, the mixture of fly ash and desulfurizing agent is preferably disposed of and fresh desulfurizing agent is preferably used as input to the moving bed.

One of the basic problems that remains with the calcium oxide desulfurizing agent system is how to dispose of the sulfur containing water produced in the process of desulfurizing the calcium sulfide of the spent desulfurizing agent composition. Water desulfurizing methods are expensive. Adding such sulfur containing waste waters to streams or the like is generally unacceptable.

Another problem with the calcium oxide desulfurizing agent system is how to achieve sufficiently rapid desulfurization of the spent dolomite without excessive use of fresh water.

SUMMARY OF THE INVENTION AND BRIEF DESCRIPTION OF THE DRAWINGS

This invention relates to an improved process and apparatus for producing a low-sulfur content hot reducing gas stream by (a) contacting a sulfur bearing hot reducing gas stream with a desulfurizing agent comprising a bed of solid particles comprising calcium oxide, such as dolomite, to thereby produce a low-sulfur content hot reducing gas stream and (b) contacting the calcium sulfide composition with hot liquid water at a temperature and corresponding pressure sufficient to maintain steam in the system to thereby convert the sulfide of the composition to calcium hydroxide and hydrogen sulfide and to produce a sulfur containing water, and then (c) recycling for reuse step (b) at least a major portion of the sulfur containing water produced in step (b) in combination with fresh water and condensate removed from the $H_2S$ stream leaving the system. Preferably the fresh water is added in an amount at least sufficient to replace the water consumed by reaction in step (b). More preferably, the fresh water added in step (c) is first used to wash the calcium hydroxide composition produced in step (b) prior to combining the fresh water with the sulfur-containing water. This assists in producing an essentially sulfur free calcium hydroxide composition without contaminating any water that will not subsequently be used in the process. The condensate, which is also relatively sulfur free, is preferably added to the last stage of contact between the solids and the boiling water to provide enhanced driving force for increasing the rate and extent of desulfurization of the spent dolomite. The weight ratio of the hot liquid water to the calcium sulfide composition immediately prior to contacting is preferably between about 1 to 1 and about 20 to 1.

Applicants' process has the advantage of achieving effective sulfur removal from the spent desulfurizing agent while at the same time eliminating any disposal problems with the sulfur containing water stream produced in the process. Moreover, in the preferred embodiment of this invention wherein the fresh water is used to wash the calcium hydroxide produced in the process a calcium hydroxide product can be produced which has very low sulfur content and which is, therefore, readily marketable as a desulfurizing agent for stack gases. This latter result is achieved without producing additional sulfur containing water having a difficult disposal problem. While it is possible to recycle the calcium hydroxide for use in desulfurizing hot reducing gases, it is generally not practical because it would have to be agglomerated to be effective in such a process. An additional advantage of a simple one-time use for the dolomite is that significant capital expenditures are eliminated that would be required in a process involving recycle of the spent dolomite.

FIG. 1 is a schematic diagram of one embodiment of the desulfurization process and apparatus of this invention.

FIGS. 2–4 are graphs showing some results of examples.

DESCRIPTION OF THE PREFERRED EMBODIMENTS

Figure 3:
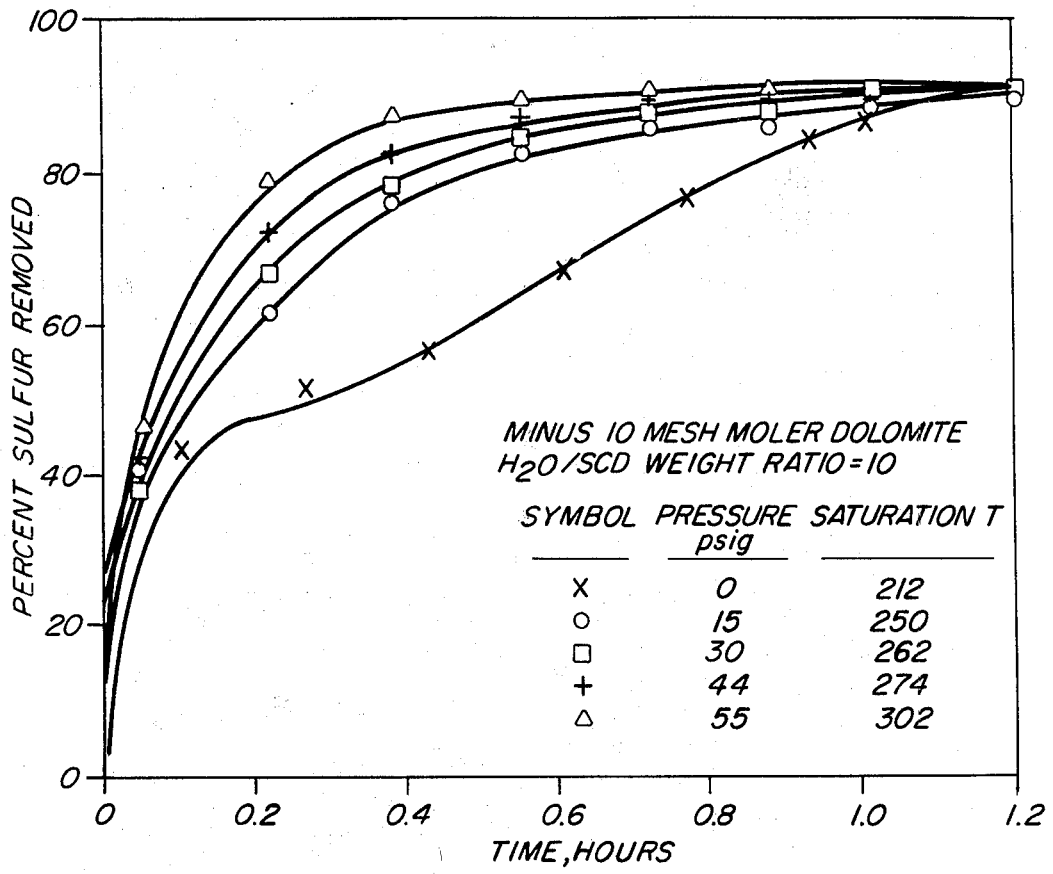

The desulfurizing agent comprising a bed of solid particles comprise calcium oxide preferably in the form of calcined dolomite or lime. The particle size of this bed is preferably between about $\frac{1}{8}$ inch and about 1 inch, and more preferably between about $\frac{1}{4}$ inch and about $\frac{1}{2}$ inch. If the particle size is below about $\frac{1}{8}$ inch, there is a serious dust problem, and if the particle size is above about 1 inch, the efficiency of the desulfurization decreases markedly.

The calcium sulfide composition produced as a result of the desulfurizing step of this invention is composed of calcium sulfide, and generally fly ash. When dolomite is utilized as the desulfurizing agent, the calcium sulfide composition will also contain magnesium oxide.

The desulfurization step is preferably conducted at temperatures between about 600° C. and about 1200° C. and more preferably between about 800° C. and about 1000° C.

The hot liquid water used to react with the calcium sulfide composition is preferably in the form of boiling water, although wet steam is also acceptable. The temperature of this reaction is preferably between about 100° C. and about 394° C., and more preferably between about 140° C. and about 250° C. and the pressure is preferably between about 1 and about 218 atmospheres, and more preferably at elevated pressures such as between about 3 and about 40 atmospheres.

The term "fresh water" used herein refers to water which is added to the process from an external source and, preferably, is water having a sulfur content lower than that of the recycle sulfur containing water produced as a by-product of the process of this invention. More preferably, the fresh water will be substantially sulfur free when initially added to the process. Part of the recycle water may come from condensing the steam produced in the process. Generally, fresh water will be added in sufficient quantities to replace the water consumed in the process by reaction in step (b), that leaving with the dry hydrogen sulfide, and the water entrained in the calcium hydroxide composition after washing with fresh water to remove the sulfur from this composition.

The calcium sulfide composition produced in the desulfurization is preferably reduced in particle size to less than about 6 mesh and preferably less than about 30 mesh immediately prior to or during the process of contacting this composition with the hot liquid water. In one embodiment the size reduction is accomplished under water after the hot gas desulfurization step and subsequent to removing the sulfur from the calcium sulfide composition by contacting with hot water.

In FIG. 1 a sulfur-bearing composition such as a hot reducing gas usually containing fly ash 1 is transferred through line 2 to fixed or moving bed desulfurization means 3 where it is contacted with a particulate calcium oxide containing desulfurizing agent transported from line 4. The desulfurizing agent is preferably introduced in the uncalcined state as raw dolomite or limestone in which case calcination will occur in the upper part of bed 3 without significant loss of temperature by the hot gas or increase of $CO_2$ content of the hot gas. The reducing gas passes through the desulfurization means 3 to exit line 5. A calcium sulfide composition passes from the desulfurization means 3 through line 6 into sulfur recovery means 7 where it is contacted with hot liquid water at a temperature and corresponding pressure sufficient to maintain steam in the system. Fresh water, and optionally condensate from the steam produced in the contacting step, enters the sulfur recovery means 7 through line 8. Hydrogen sulfide and steam pass through exit line 9 from the sulfur recovery means 7. The steam may be condensed and reused as recycle water. A calcium hydroxide containing composition passes through exit line 10 from sulfur recovery means 7. Sulfur containing water passes through exit line 11 where it is combined with fresh water which is added to the process by means of inlet line 12.

In the step of contacting the calcium sulfide composition with hot liquid water, the weight ratio of hot liquid water to calcium sulfide composition immediately prior to contacting is between about 1:1 and about 20:1, and more preferably between about 6:1 and about 10:1. The hot liquid water may be in the form of steam or boiling water.

Preferably two or more tanks are used sequentially for contacting the sulfur containing composition with the hot liquid water.

Preferably the water vapor produced in the process is condensed and returned to the process, such as by adding to the final stage of the step of contacting liquid water with the calcium sulfide composition.

EXAMPLES

The process and apparatus of FIG. 1 is used to carry out the following examples. The step of contacting the calcium sulfide composition with hot liquid water is carried out by means of two separate vessels containing such water.

Sulfided dolomite from pilot-plant studies where the dolomite was used as a desulfurizing agent was crushed to provide feed for the experiments ranging in size from minus 10 mesh to minus 20 mesh. Following is a chemical analysis of this material.

| Constituent | Weight Percent |
|---|---|
| CaO | 2.36 |
| CaS | 60.07 |
| MgO | 35.62 |
| $Al_2O_3$ | 0.13 |
| $Fe_2O_3$ | 0.60 |
| $M_mO$ | 0.05 |
| $SiO_2$ | 0.72 |
| | 99.55 |
| S Total | 26.70 |

EFFECT OF WATER ($H_2O$) SULFIDED CALCINED DOLOMITE (SCD) WEIGHT RATIO

The effect of $H_2O$/SCD weight ratio was studied over the range 6 to 20 with minus 10 mesh material at atmospheric pressure and at 55 psig. The results are shown in FIG. 2 as percent sulfur removal versus time with $H_2O$/SCD weight ratio and pressure as parameters. Increasing the $H_2O$/SCD weight ratio above 10 did not result in a significant improvement in sulfur removal rate over the range of operating pressures studied. It is interesting to note that there is a marked increase in sulfur removal rate with increasing pressure at all $H_2O$/SCD weight ratios.

EFFECT OF PRESSURE (SATURATION TEMPERATURE)

The effect of pressure (saturation temperature) on sulfur removal rate was studied with minus 10 mesh sulfided calcined dolomite and $H_2O$/SCD weight ratio of 10. The results are presented in FIG. 3 as percent sulfur removed versus time with pressure as a parameter. Similar results were obtained with minus 100 mesh dolomite. The sulfur removal rate increases with increasing pressure (saturation temperature), the increase being particularly marked when the pressure increases from one to two atmospheres.

EFFECT OF RECYCLE $H_2O$

Figure 4:
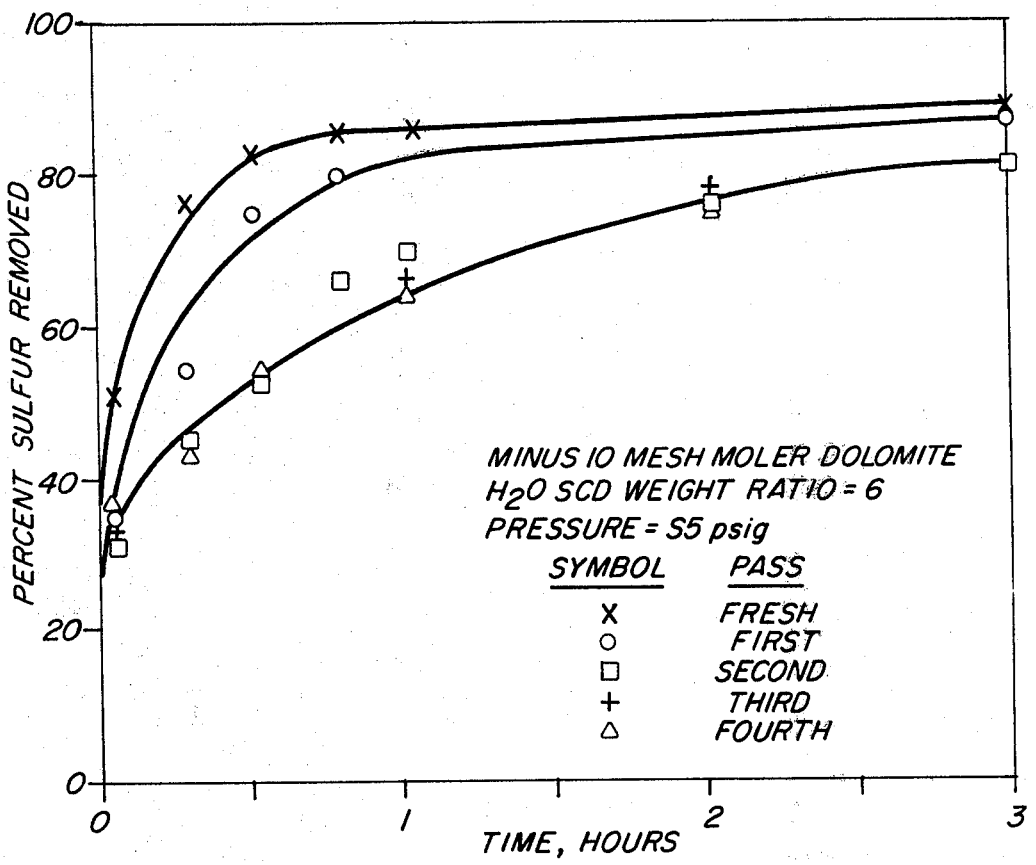

Because the reactions in the treatment of sulfided calcined dolomite with boiling water result in a net water consumption, the desired $H_2O$/SCD weight ratio is obtained by recycling water separated from the hydrated product. The fresh water for reaction is introduced as a wash stream to clear the hydrated solids of "spent" recycle water and provide the cleanest possible solids for disposal or use. Tests were, therefore, conducted to determine the effect of recycle water on the degree and rate of sulfur removal. The water separated from the slurry at the end of each batch test was used to make up the starting bath for the succeeding test. The bath for each test was made up with 80 percent recycle water and 20 percent fresh water to simulate conditions in an actual flowsheet. The results are shown in FIG. 4 as percent sulfur removed versus time with pass number as a parameter (with repeated use, the water will tend to approach a steady state sulfur content so that the retarding effect of this variable should also stabilize at some steady-state level). After two passes with recycle the sulfur removal versus time curves do reach a steady-state (superimposed).

EFFECT OF WASHING ON FINAL SULFUR CONTENT

The retarding effect of recycle water on the rate of sulfur removal is the direct result of a buildup in sulfur and "sulfur ion" concentration in the slurry water. All of the prior solid analyses were affected because the solids were dried before analysis without washing, with the result that sulfur contained in the residual water remained with the sample. This effect is illustrated quantitatively in the following Table 1 which presents a comparison of final percent sulfur removals for unwashed and washed samples for most of the later experiments.

TABLE 1

COMPARISON OF PERCENT SULFUR REMOVED IN FINAL SOLIDS - UNWASHED AND WASHED

| Test No. | Duration Hours | Pressure PSIG | $H_2O$/SCD | Size -Mesh | Percent S Removed Unwashed | Percent S Removed Washed | Δ |
|---|---|---|---|---|---|---|---|
| 34 | 5 | 0 | 10 | 100 | 92.9 | 98.4 | 5.5 |
| 35 | 5 | 15 | 10 | 100 | 94.1 | 98.9 | 4.8 |
| 36 | 5 | 30 | 10 | 100 | 92.3 | 98.6 | 6.3 |
| 37 | 5 | 44 | 10 | 100 | 92.1 | 98.6 | 6.5 |
| 38 | 5 | 55 | 10 | 100 | 93.1 | 98.8 | 5.7 |
| 40 | 3 | 55 | 15 | 10 | 96.4 | 97.7 | 1.3 |
| 41 | 3 | 0 | 20 | 10 | 95.5 | 98.3 | 2.8 |
| 42 | 3 | 55 | 20 | 10 | 95.5 | 98.2 | 2.7 |
| 43 | 3 | 0 | 15 | 100 | 94.9 | 98.9 | 4.0 |
| 44 | 3 | 55 | 15 | 100 | 94.6 | 98.8 | 4.2 |
| 45 | 3 | 0 | 20 | 100 | 95.8 | 99.2 | 3.4 |
| 46 | 3 | 55 | 20 | 100 | 96.2 | 99.0 | 2.8 |
| 47 | 4 | 0 | 10 | 200 | 92.0 | 97.9 | 5.9 |
| 48 | 4 | 55 | 10 | 200 | 92.2 | 98.4 | 6.2 |
| 49 | 3 | 55 | 6 | 10 | 88.8 | 97.5 | 8.7 |
| 50 | 3 | 30 | 6 | 10 | 87.2 | 97.2 | 10.0 |
| 51 | 3 | 0 | 6 | 10 | 88.7 | 96.6 | 7.9 |

TABLE 1-continued

COMPARISON OF PERCENT SULFUR REMOVED IN FINAL SOLIDS - UNWASHED AND WASHED

| Test No. | Duration Hours | Pressure PSIG | $H_2O$/SCD | Size -Mesh | Percent S Removed Unwashed | Percent S Removed Washed | Δ |
|---|---|---|---|---|---|---|---|
| 52 | 3 | 55 | 6 | 10 | 88.6 | 96.5 | 7.9 |
| 53* | 3 | 55 | 6 | 10 | 87.0 | 95.7 | 8.7 |
| 54* | 4 | 55 | 6 | 10 | 84.5 | 95.5 | 11.0 |
| 55* | 4 | 55 | 6 | 10 | 87.4 | 96.9 | 9.5 |
| 56* | 4 | 55 | 6 | 10 | 86.3 | 95.4 | 9.1 |

*Runs 53, 54, 55, 56 were run with 80% recycle water 1,2,3 & 4 passes

The data presented in this Table 1 clearly show the effects of washing on percent sulfur removal and of using higher $H_2O$/SCD weight ratios when the treatment is done without recycle water. The effect of recycle water is similar to using a lower $H_2O$/SCD weight ratio. The average of the Δ's between unwashed and washed samples is 4.4 percentage points for $H_2O$/SCD of 10 compared with 9.1 percentage points for $H_2O$/SCD of 6.

CONTINUOUS TREATMENT RESULTS

The results of some continuous boiling-water-leach tests are summarized in Tables 2 and 3. Table 2 shows the effect of residence time on the steady-state percent sulfur removal with constant $H_2O$/SCD weight ratio of 6, and FIG. 3 shows the effect of $H_2O$/SCD weight ratio on the steady-state percent sulfur removal with constant residence time of 12 hours. These results indicate that a residence time of at least 10 hours with $H_2O$/SCD weight ratio of at least 6 will be needed to provide the desired percent sulfur removal and that certain special arrangements will be needed to overcome the adverse effects of recycle $H_2O$.

TABLE 2

EFFECT OF RESIDENCE TIME ON STEADY STATE PERCENT SULFUR REMOVAL, $H_2O$/SCD = 6

| Residence Time, Hours | Percent Sulfur Removed |
|---|---|
| 12 | 93.5 |
| 8 | 91.0 |
| 4 | 82.5 |
| 4 with Recycle $H_2O$ | 75.0 |

TABLE 3

EFFECT OF $H_2O$/SCD WEIGHT RATIO ON STEADY STATE PERCENT SULFUR REMOVAL, RESIDENCE TIME = 12 HOURS

| $H_2O$/SCD Weight Ratio | Percent Sulfur Removed |
|---|---|
| 10 | 94.0 |
| 6 | 93.5 |
| 4 | 88.0 |
| 2 | 78.0 |

We claim:

1. A process for producing a low-sulfur content hot reducing gas stream comprising (a) contacting a sulfur bearing hot reducing gas stream with a desulfurizing agent comprising a bed of solid particles comprising calcium oxide to thereby produce a low-sulfur content hot reducing gas stream and a calcium sulfide composition, then (b) contacting said calcium sulfide composition with hot liquid water at a temperature and corresponding pressure sufficient to maintain steam in the system to thereby convert the sulfide of said composition to calcium hydroxide and hydrogen sulfide and to produce a sulfur containing water, and then (c) repeatedly recycling for reuse in step (b) at least a major portion of the sulfur containing water produced in step (b) in combination with fresh water which is repeatedly added in amounts sufficient to achieve effective sulfur removal from said calcium sulfide composition and wherein said fresh water added in step (c) is first used to wash the calcium hydroxide produced in step (b) prior to combining said fresh water with said sulfur containing water.

2. Process as in claim 1 wherein said fresh water is added in an amount sufficient to replace the water lost by reaction in step (b), that leaving with the dry hydrogen sulfide, and that leaving in the dewatered calcium hydroxide composition.

3. Process as in claim 1 wherein the weight ratio of said hot liquid water to said calcium sulfide composition immediately prior to contacting is between about 1 to 1 and about 10 to 1, and wherein said bed of solid particles is a moving bed.

4. Process as in claim 1 wherein said desulfurizing agent comprises calcined dolomite or lime.

5. Process as in claim 1 wherein said desulfurizing agent in step (a) has a particle size of between about $\frac{1}{4}$ inch and about $\frac{1}{2}$ inch.

6. Process as in claim 1 additionally comprising the step of condensing steam produced in step (b) and returning the water thus produced to the final contact stage in step (b).

7. Process as in claim 4 wherein substantially all of said desulfurizing agent is reduced in size under water after step (a) and prior to step (b).

8. A process for producing a low-sulfur content hot reducing gas stream comprising (a) contacting a sulfur bearing hot reducing gas stream comprising (a) contacting a sulfur bearing hot reducing gas stream with a desulfurizing agent comprising a bed of solid particles comprising calcium oxide to thereby produce a low-sulfur content hot reducing gas stream and a calcium sulfide composition, then (b) contacting said calcium sulfide composition with hot liquid water at a temperature and corresponding pressure sufficient to maintain steam in the system and wherein a major portion of said calcium sulfide composition has a particle size of less than about 6 mesh to thereby convert the sulfide of said composition to calcium hydroxide and hydrogen sulfide and to produce a sulfur containing water, then (c) repeatedly recycling substantially all of said sulfur containing water from step (b) for reuse in step (b) such that the recycled water tends to approach a steady state sulfur content, and (d) adding sufficient fresh water to the recycle water from step (c) to at least substantially replace that water lost by reaction in step (b), that leaving with the dry hydrogen sulfide, and that leaving in the dewatered calcium hydroxide composition, and wherein the weight ratio of said hot liquid water to said calcium sulfide composition immediately prior to contacting is between about 1 to 1 and about 20 to 1.

9. Process as in claim 8 wherein the weight ratio of said hot liquid water to said calcium sulfide immediately prior to contacting said calcium sulfide composition with said hot liquid water is between about 6 to 1 and about 10 to 1.

10. Process as in claim 8 wherein said hot liquid water is wet steam or boiling water.

11. Process as in claim 8 wherein said desulfurizing agent comprises calcined dolomite or lime.

12. Process as in claim 8 wherein immediately after step (b) the composition containing said calcium hydroxide is washed with fresh water to remove substantially all of said sulfur containing water.

13. Process as in claim 12 wherein two or more tanks are used sequentially for contacting said sulfur containing composition with said hot liquid water.

14. Process as in claim 8 wherein said desulfurizing agent in step (a) has a particle size of between about ¼ inch and about ½ inch.

15. Process as in claim 14 wherein substantially all of said desulfurizing agent is reduced in size by crushing after step (a) and prior to step (b).

16. Process of reducing oxide by contacting ore with a hot reducing gas produced by the process of claim 8.

17. Process as in claim 14 wherein said oxide is iron oxide.

18. Process of claim 8 additionally comprising the step of using the hot desulfurized reducing gas produced in step (a) for power generation.

19. A process for desulfurizing a hot reducing gas stream comprising (a) contacting said gas stream with a desulfurizing agent comprising a moving bed of solid particles comprising calcium oxide at temperatures between about 600° C. and about 1200° C. to produce a low-sulfur content hot reducing gas stream and a calcium sulfide composition, said bed moving at a rate sufficient to prevent fly ash plugging of said bed, then (b) contacting said calcium sulfide composition with hot liquid water at a temperature and corresponding pressure sufficient to maintain steam in the system and wherein a major portion of said calcium sulfide composition has a particle size of less than about 6 mesh to thereby convert the sulfide of said composition to calcium hydroxide and hydrogen sulfide and to produce a sulfur containing water, then (c) repeatedly recycling substantially all of the remaining sulfur containing water from step (b) for reuse in step (b) such that the recycled water tends to approach a steady state sulfur content, and (d) adding sufficient fresh water to the recycle water from step (c) to at least substantially replace that water lost by reaction in step (b), that leaving with the dry hydrogen sulfide, and that leaving in the dewatered calcium hydroxide composition, and wherein the weight ratio of said hot liquid water to said calcium sulfide composition immediately prior to contacting is between about 1 to 1 and about 20 to 1.

20. Process as in claim 19 wherein the temperature of step (a) is between about 800° to about 1000° C. and wherein step (b) is continued until the conversion of said sulfide to said calcium hydroxide and said hydrogen sulfide is substantially complete.

21. Process as in claim 19 wherein said hot liquid water is wet steam or boiling water.

22. Process as in claim 19 wherein said desulfurizing agent comprises calcined dolomite or lime.

23. Process as in claim 19 wherein said desulfurizing agent in step (a) has a particle size of between about ¼ inch and about ½ inch.

24. Process as in claim 23 wherein substantially all of said desulfurizing agent is reduced in size by crushing after step (a) and prior to step (b).

25. Process as in claim 23 wherein substantially all of said desulfurizing agent is reduced in size after step (a) and prior to step (b) to a particle size of less than about 10 mesh by crushing and then pouring into boiling water while rapidly agitating said water, and then continuing said boiling until said calcium sulfide is substantially completely converted to calcium hydroxide and hydrogen sulfide.

26. Process as in claim 25 wherein step (b) is carried out at a pressure between about 3 and about 40 atmospheres, and at a temperature of between about 140° C. and about 250° C.

27. Process as in claim 25 wherein in step (a) said desulfurizing agent comprises calcined dolomite having a particle size of between about ¼ and about ½ inch.

28. Process as in claim 25 wherein water vapor produced in step (b) is condensed and recycled for use in step (b) by adding to the final contact stage in step (b).

* * * * *